US005357176A

United States Patent [19]

Nishio et al.

[11] Patent Number: 5,357,176

[45] Date of Patent: Oct. 18, 1994

[54] CATHODE RAY TUBE

[75] Inventors: Chie Nishio; Shunichi Igeta; Koji Nakamura, all of Nagaokakyo, Japan

[73] Assignee: Mitsubishi Denki Kabushiki Kaisha, Tokyo, Japan

[21] Appl. No.: 902,844

[22] Filed: Jun. 23, 1992

[30] Foreign Application Priority Data

Jun. 27, 1991 [JP] Japan ..... 3-156371

[51] Int. Cl.[5] ..... H01J 29/80

[52] U.S. Cl. ..... 315/376; 315/410; 313/439

[58] Field of Search ..... 315/410, 376; 313/432, 313/434, 435, 436, 439

[56] References Cited

U.S. PATENT DOCUMENTS 2,981,864 4/1961 Burdick et al. ..... 313/439
3,005,921 10/1961 Godfrey ..... 313/439
5,038,074 8/1991 Nakamura .

FOREIGN PATENT DOCUMENTS 0942277 5/1956 Fed. Rep. of Germany .
1101494 3/1961 Fed. Rep. of Germany .
39-82435 3/1964 Japan .
2195633 8/1990 Japan .

*Primary Examiner*—Theodore M. Blum

[57] ABSTRACT

A thin cathode ray tube. A low voltage is applied to a beam of electrons produced by an electron gun. The electron beam is electromagnetically deflected through a large angle. Four static deflectors are used to deflect and accelerate the beam of electrons, and to let the beam of electrons have a sufficient energy level when it reaches a fluorescent screen. The cathode ray tube can effectively increase the deflection angle of the beam of electrons and reduce an incident angle of the beam of electrons so as to reproduce an image with less distortion.

18 Claims, 7 Drawing Sheets

CATHODE RAY TUBE

BACKGROUND OF THE INVENTION

1. Field of the Invention

This invention relates to a cathode ray tube, and more particularly to a cathode ray tube in which a beam of electrons is deflected by an electromagnetic deflector and a static deflector.

2. Description of the Related Art

As shown in FIG. 6 of the accompanying drawings, a cathode ray tube is a glass bulb having a panel 1 and a funnel 2. A beam of electrons is produced by an electron 5 gun 4 located in the neck 3 of the funnel 2 and deflected by a deflection yoke 7 near a cone 6 of the funnel 2. The beam of electrons 5 is then focused onto a fluorescent screen layer 8 inside the panel 1 and is scanned so as to reproduce an image.

A television receiver is required to be compact and thin. However, the television receiver is also required to have a large display screen. It is therefore essential to make the cathode ray tube as thin as possible. One approach for this purpose is to enlarge a maximum deflection angle of the electron beam. This approach will be described with reference to FIG. 7. As described above, an electron gun 4 produces a beam of electrons, a direction of which is changed by a deflection yoke 7 while the electron beam passes through a magnetic field generated by the yoke 7. An angle by which the electron beam is redirected is called the "angle of deflection". When the electron beam is scanned at a periphery of a fluorescent screen, it has a maximum deflection angle. The length of the cathode ray tube depends upon the maximum deflection angle of the electron beam. Specifically, when the display screen has a height 2S, the electron beam 5 from the electron gun 4 is deflected at a deflection point 0 with an angle $\theta$. It is assumed that the electron beam has a deflection angle $\theta_0$ (maximum deflection angle) at the periphery of the display screen. An overall length of the cathode ray tube, F, is expressed as follows:

$$F=T+L+M+G$$

$$L=S/\tan\theta_0$$

where L represents a length between the deflection point 0 and the display screen , M a length between the deflection point 0 and the forward edge of the electron gun 4, G a length of the electron gun, and T a thickness of the panel. According to this formula, L can be reduced by enlarging the maximum deflection angle $\theta_0$, which means a reduction in the length of the cathode ray tube. Table 1 shows a relationship between the deflection angles and the entire length F of a 37-inch cathode ray tube as an example.

TABLE 1

| (Max. deflec. angle $\Theta_0$) × 2 | Whole length F |
|---|---|
| 90° | 1090 mm |
| 110° | 810 mm |
| 130° | 590 mm |
| 150° | 440 mm |

where T+M+G=150 mm.

The larger the maximum deflection angle, the shorter the cathode ray tube as a whole. However, it is necessary to raise the level of energy applied to the deflection yoke and intensify the electric field to be generated when the deflection angle is made as large as possible while keeping the electron beam at a predetermined energy level. For this purpose, an electromagnetic deflector having a high output level should be used, which means a possible increase in the size of the television receiver and in power consumption.

Further when deflection angle is large, the electron beam will be radiated onto the fluorescent screen 8 with a large incident angle $\Phi$, thereby causing distortion of a reproduced image in the peripheral region of the display screen.

Japanese Patent Laid-Open Publication Sho 64-82435 (1989) exemplifies a method for reducing an incident angle of the electron beam by deflecting the electron beam electromagnetically once and deflecting it statically twice.

With the foregoing example, the electron beam has not only a high acceleration voltage but also a high energy level. Therefore, the magnetic field should be strong enough to cope with such an electron beam. In addition, a voltage for static deflection should be high enough. Application of the high voltage requires that both the electromagnetic deflector and the static deflectors should be large. A power supply for these deflectors would inevitably become large too. Such large apparatuses would consume a large amount of power.

SUMMARY OF THE INVENTION

It is therefore an object of this invention to provide a cathode ray tube which can solve the foregoing problems of conventional apparatuses, and can deflect a beam of electrons efficiently by using deflectors operable with a low voltage.

According to this invention, a low acceleration voltage is applied to an electron gun to provide a beam of electrons have a low initial energy level. An electromagnetic deflector generates a weak magnetic field to deflect the beam of electrons through a sufficient angle. Four static deflectors generate magnetic fields to further deflect the beam of electrons, so that a path of the beam of electrons can be corrected to be incident on the fluorescent screen along the normal.

Electric fields generated by the four static deflectors accelerate the beam of electrons, so that the beam of electrons will be focused onto the fluorescent screen with a sufficient energy level.

As shown in FIG. 3, the electron beam is easily deflected in a retarding field b (low electric field). On the other hand, the electron beam is slow to be deflected in accelerating fields a and c (high electric fields). In a field d, the electron beam is scarcely deflected and remains very stable near the fluorescent screen 8.

With this arrangement, the cathode ray tube can minimize the increase of power of the deflection yoke, thereby reducing power consumption.

Path analysis of the electron beam is performed by computer simulation according to the surface charge method, referred to Chapter 2.5, of the article on the electric charge weighing method and surface charge method, on pages 44–47, "Electron Beam Handbook", Version 2, published by Nikkan Kogyo Shinbunnsha.

The simulation was carried out under the following condition. The target incident angle $\theta^*$ is assumed to be less than half the conventional incident angle ($\theta^* < \theta/2$), and the target deflection distance d* is more than the conventional deflection distance d (d*>d).

DETAILED DESCRIPTION OF THE PREFERRED EMBODIMENT

Figure 1:
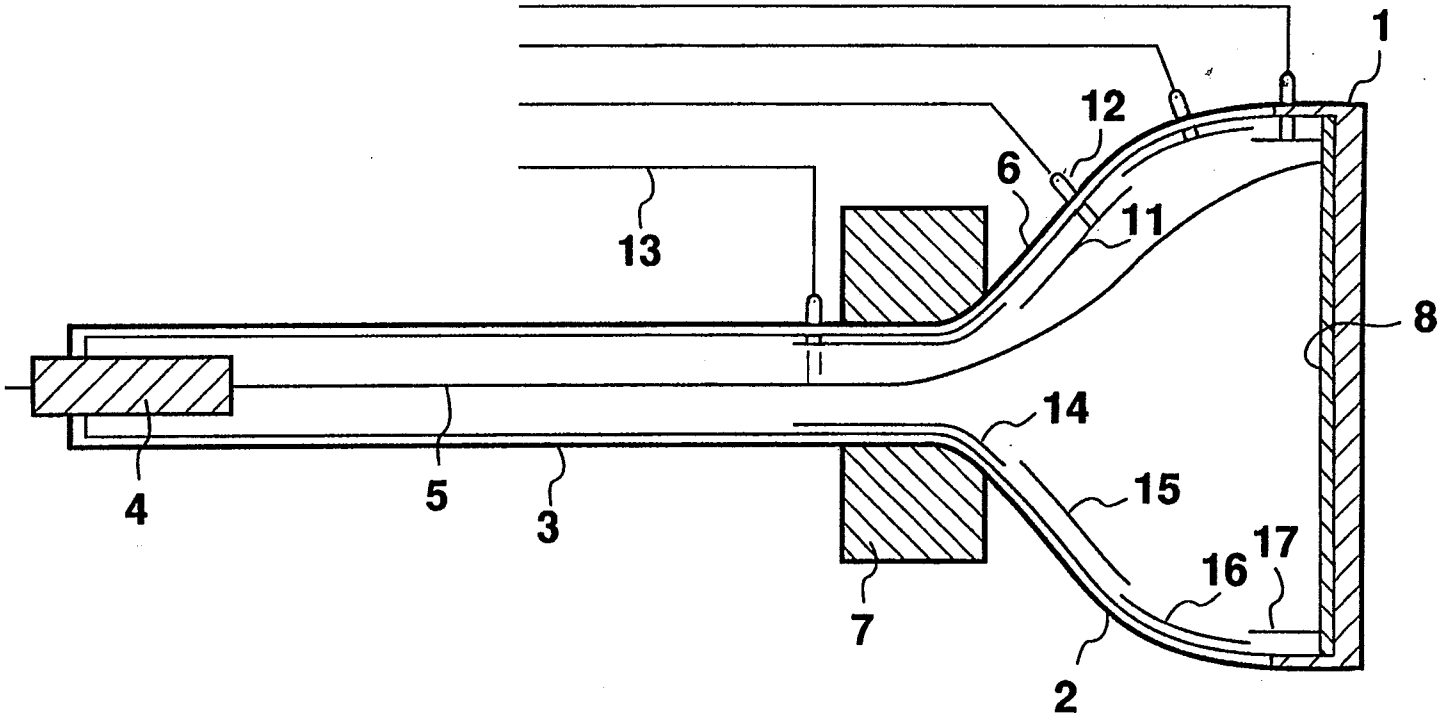
FIG. 1 is a cross-sectional view of a cathode ray tube according to an embodiment of this invention.
Figure 6:
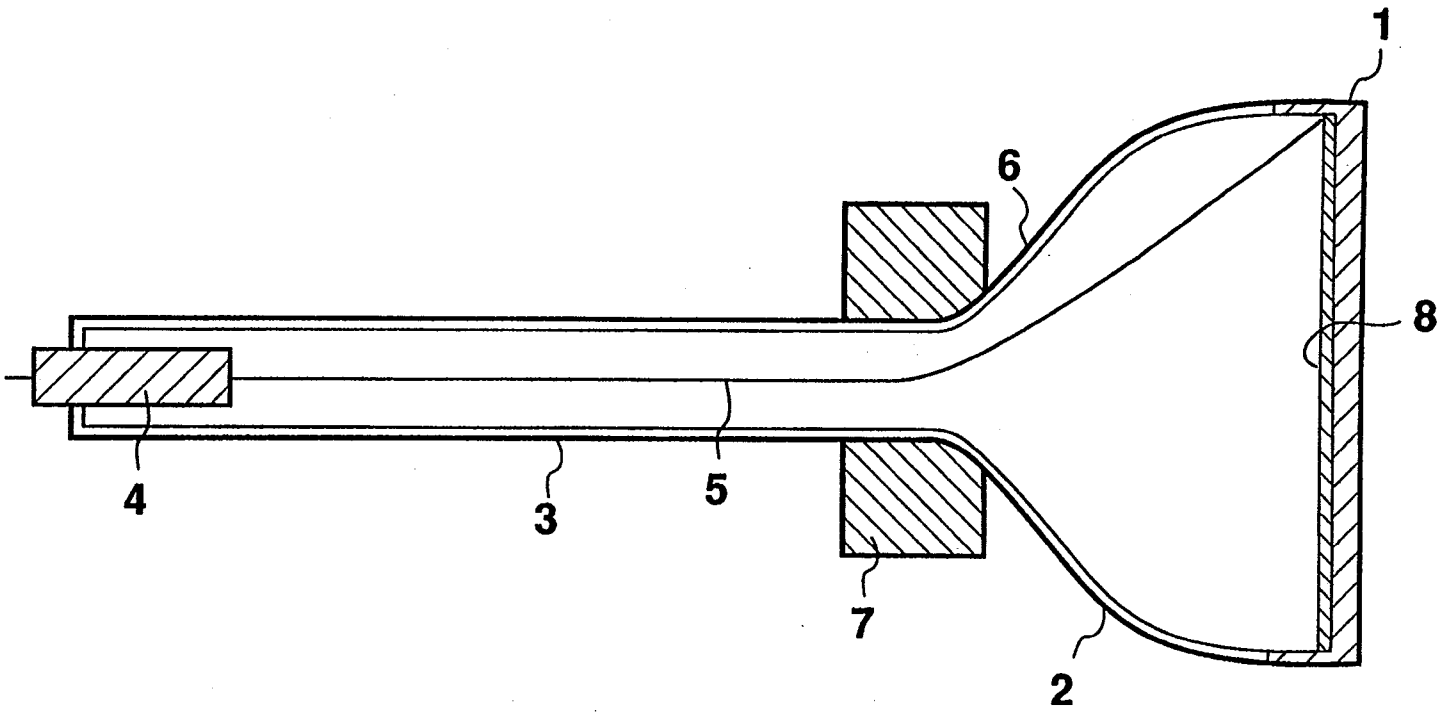
Fig. 6 Prior Art
FIG. 6 is a cross-sectional view of a conventional cathode ray tube.
Figure 7:
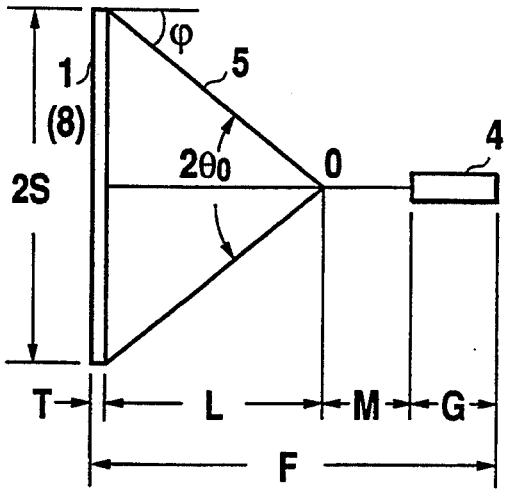
FIG. 7 shows a total length of the cathode ray tube, and a deflection angle of the electron beam.

As shown in FIG. 1, a cathode ray tube includes first to fourth electrodes 14 to 17 as well as the components 1 to 8 which are identical to those of the conventional cathode ray tube shown in FIG. 6. Each of the electrodes 14 to 17 has a plurality of electrode elements, and serves as a static deflector electrode. A predetermined voltage is applied to each electrode via a pin 12 and a lead wire 13, thereby forming an electric field. The electrodes 14 to 17 constitute a static deflector.

Figure 2:
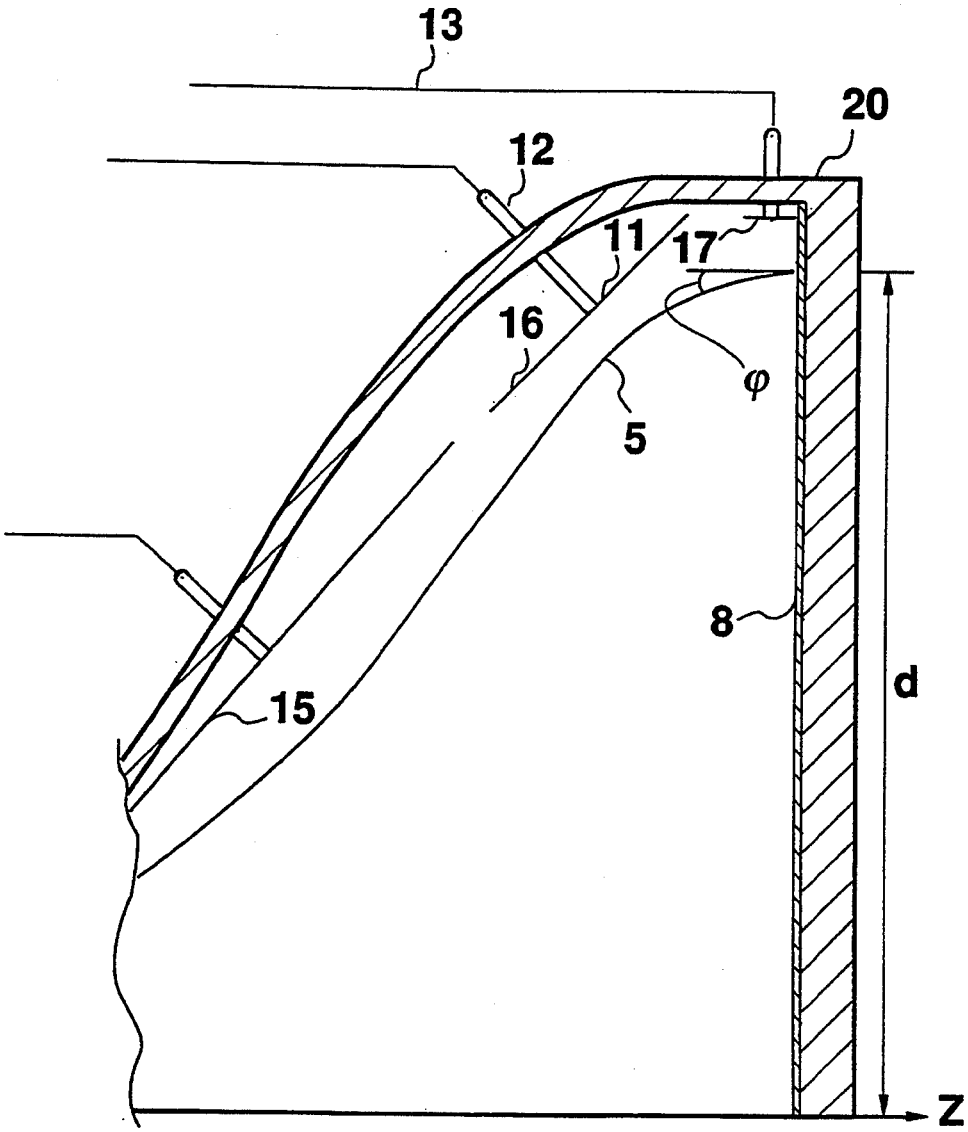
FIG. 2 shows a path of a beam of electrons in the cathode ray tube of FIG. 1.

An acceleration voltage $V_0$ of the electron gun 4 is set to 5 kV. The voltages applied to the first to fourth electrodes 14 to 17 are 5 kV, 30 kV, 10 kV and 30 kV, respectively, as the applied voltages $V_1$, $V_2$, $V_3$ and $V_4$. The beam of electrons has a path as shown in FIG. 2.

Figure 3:
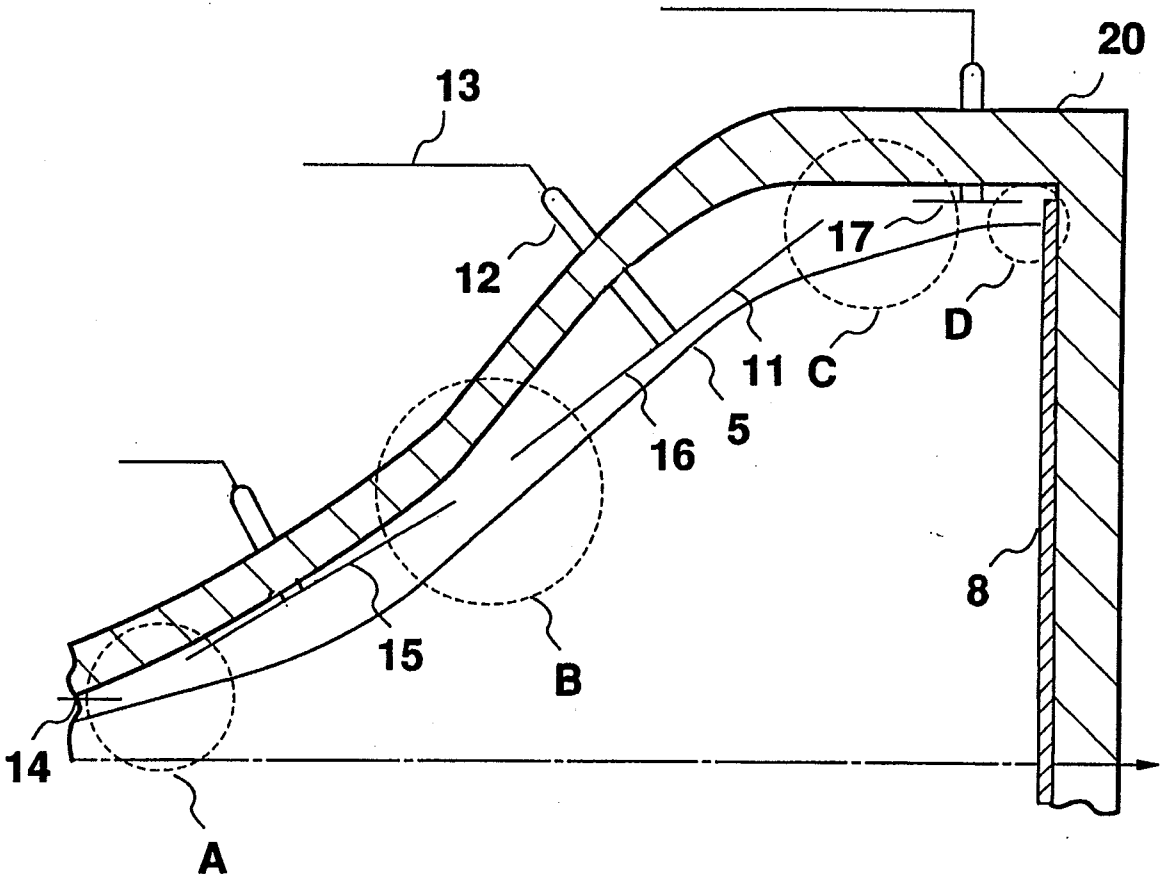
FIG. 3 shows a manner in which the beam of electrons is deflected in the electric fields.

The electron beam produced by the electron gun 4 has a low acceleration voltage $V_0$ as described above. Therefore, the electron beam can be deflected through a large angle in a weak electric field, so that the static deflector can be small in size. The electron beam passing through the electromagnetic deflector is accelerated in response to a potential difference between the first and second electrodes 14 and 15 (shown at a in FIG. 3). The electron beam is further deflected by the second electrode 15, and is somewhat decelerated between the second and third electrodes 15 and 16 (shown at b in FIG. 3). Then, the electron beam is deflected by the third electrode 16 so as to reduce its deflection angle. Under this condition, the electron beam has been decelerated at b shown in FIG. 3, being is easily deflected. Therefore, the electron beam can be deflected even when a low voltage is applied to the third electrode 16. The electron beam is accelerated between the third and fourth electrodes 16 and 17 (shown at c in FIG. 3). Thereafter, the electron beam is deflected again by the fourth electrode 17, being further accelerated by the voltage applied to the fluorescent screen 8. The electron beam has a sufficient energy level when reaching the fluorescent screen 8.

Under this condition, the electron beam 5 has the deflection distance d and incident angle Φ as shown in TABLE 2.

TABLE 2

| | Present invention | Conven. path 1 | Conven. path 2 | Ratio Present/ path 1 | Ratio Present/ path 2 |
|---|---|---|---|---|---|
| d | 66.92 | 46.29 | 66.02 | 1.45 times | 1.01 times |
| Φ | 0.191 | 0.50 | 0.20 | 38.2% | 95.5% |

Present invention: $V_0$, $V_1$ = 5 kV, $V_2$ = 30 kV, $V_3$ = 10 kV, $V_4$ = 30 kV
Path 1 $V_0$, $V_1$ = 5 kV, $V_2$ = 30 kV, $V_3$ = 10 kV, $V_4$ = 30 kV
Path 2 $V_0$, $V_1$ = 5 kV, $V_2$ = 60 kV, $V_3$ = 10 kV, $V_4$ = 30 kV It is assumed here that a reference voltage H is applied to the fluorescent screen 8. The voltage $V_1$ applied to the first electrode 14 is 20%±20% of H, $V_2$ to the second electrode 15 is 100%±20% of H, $V_3$ to the third electrode 16 is 30%±20% of H, and $V_4$ to the fourth electrode 17 is 100%±20% of H.

Figure 4:
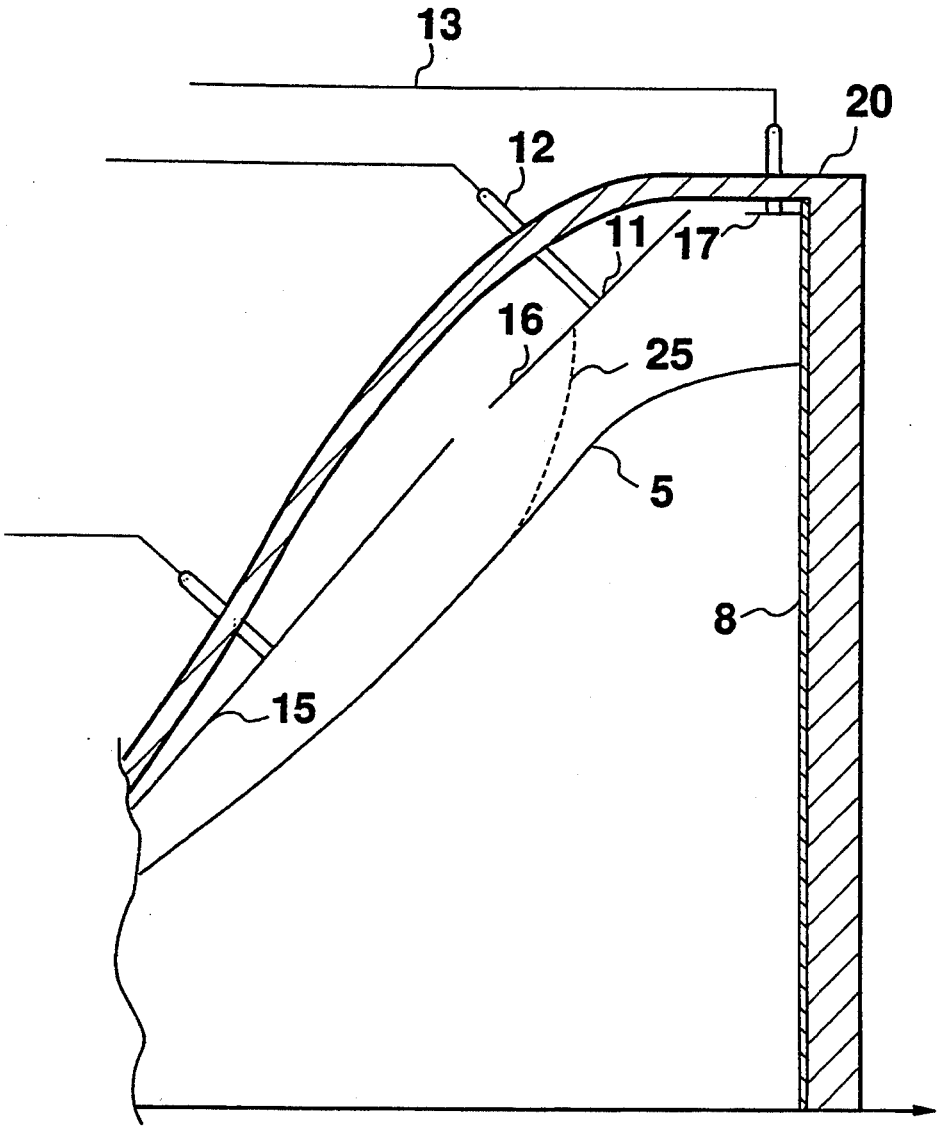
FIG. 4 shows a relationship between a voltage applied to deflection electrodes and orbits of the beam of electrons.

When the applied voltages exceed the foregoing values, the electron beam 5 collides with the deflector electrode and advances along a path shown by a broken line 25 in FIG. 4 before reaching the fluorescent screen 8. In addition, the electron beam 5 may fail to collide with the target position on the fluorescent screen 8 and sometimes advance along a path 26 shown in FIG. 5.

TABLE 3 shows the relationship between the applied voltages and the deflection magnetic fields.

TABLE 3

| | Position | | | | | | |
|---|---|---|---|---|---|---|---|
| | $V_0$ | $V_1$ | $V_2$ | $V_3$ | $V_4$ | B | Φ |
| | Unit | | | | | | |
| FIG. | kV | kV | kV | kV | kV | $\times 10^4$ wb/m$^2$ | rad |
| 2 | 5 | 5 | 30 | 10 | 30 | 35 | 0.191 |
| 4 | 5 | 5 | 50 | 10 | 30 | 35 | — |
| 5 | 5 | 5 | 40 | 10 | 30 | 35 | −12.0 |

Figure 5:
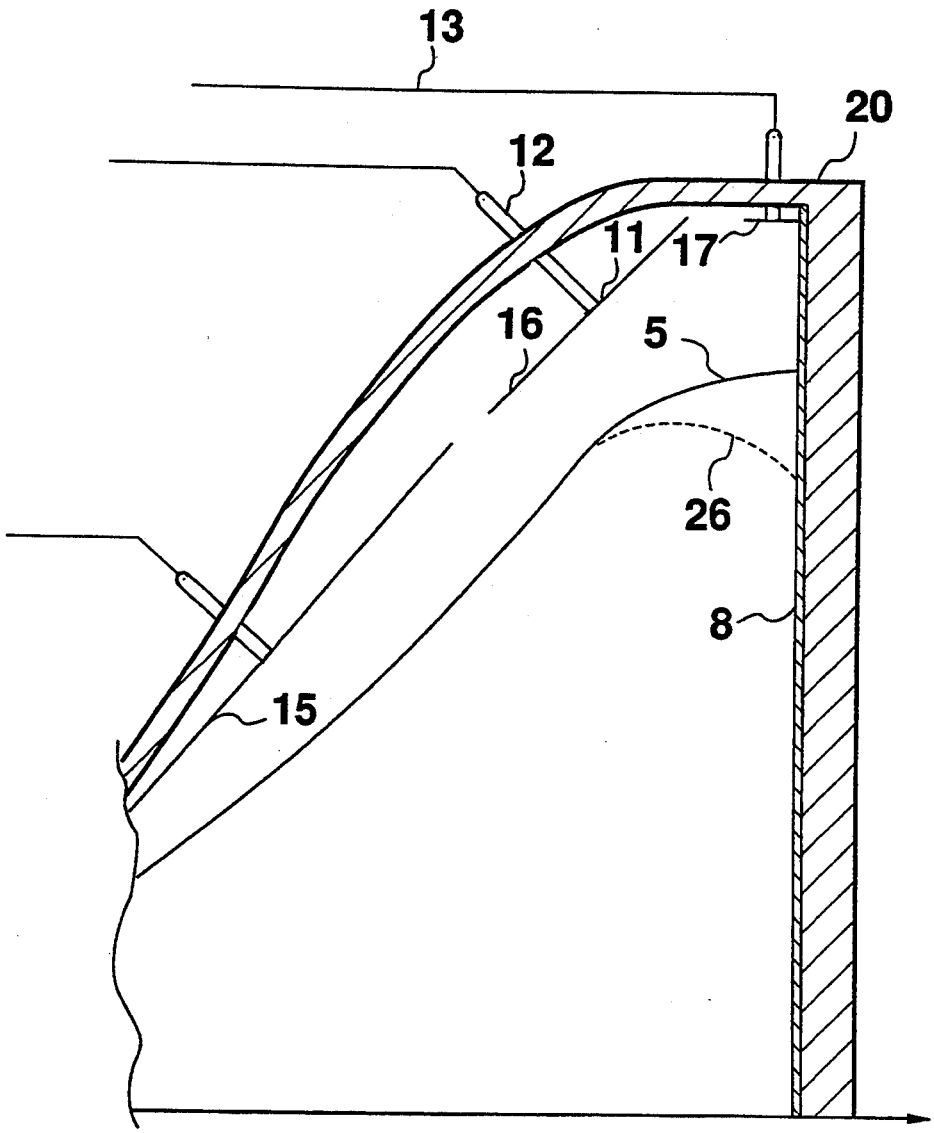
FIG. 5 is a view similar to FIG. 4.

Therefore, it is necessary to determine appropriately the voltages applied to the electrodes to prevent the electron beam from advancing along the undesired path 25 or 26 as shown in FIG. 4 or 5.

Figure 8:
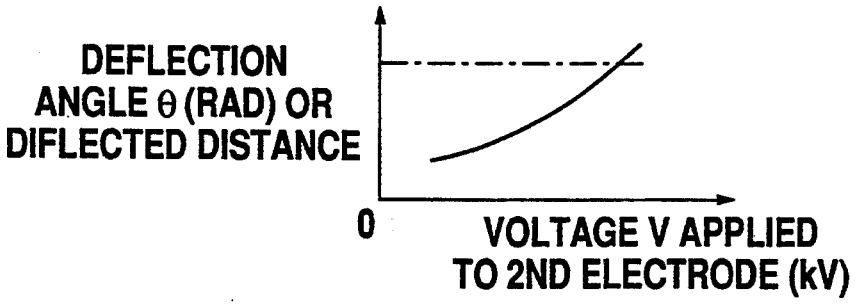
FIG. 8 shows a relationship between an applied voltage and a wide deflection angle.
Figure 9:
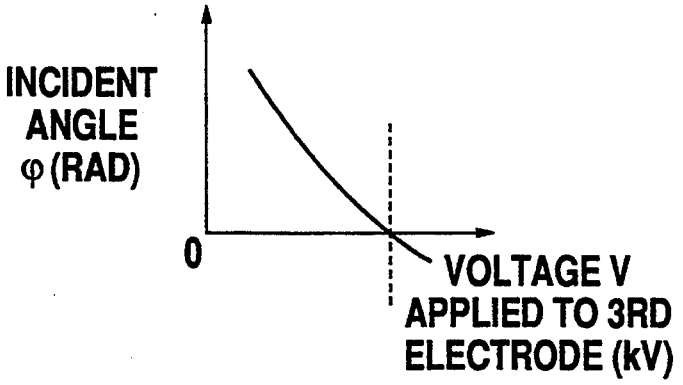
FIG. 9 shows a relationship between the applied voltage and an incident angle of the electron beam.

For example, when the voltage to the second electrode is increased, the electron beam will be further deflected accordingly. However, if the electron beam is deflected with an angle above the predetermined angle, the electron beam may not reach the fluorescent screen 8. A marginal value is shown by a dash-and-dot line in FIG. 8. The voltage applied to the second electrode 15 has its upper limit determined according to this marginal value. If the voltage to the fourth electrode 17 is increased, the incident angle Φ will be reduced accordingly. When a voltage above the preset value is applied, the incident angle Φ will become negative, thereby offsetting the advantage obtained by a large deflection angle $\theta$. Therefore, the voltage of the fourth electrode is determined to keep the incident angle Φ positive. Experiments were carried out to determine the voltages to be supplied to the electrodes so that the electron beam does not show the paths of FIGS. 4 and 5. It is preferable that each voltage to each electrode should be ±20% of the reference voltage.

In the foregoing embodiment, a monochromatic display tube is described as an example. However, the tube may be of any other type such as a shadow-mask type.

According to this invention, the beam of electrons can be electromagnetically deflected in a low electric field. Since the electron beam is incident onto the fluorescent screen with a small angle compared with the conventional devices, the electron beam has a small deflection angle and will not be distorted in the sectional area thereof. Therefore, the cathode ray tube can assure excellent reproduction of images, and offers a high quality television receiver at a reduced cost.

What is claimed is:

1. A cathode ray tube comprising:

a vacuum tube having a panel, a fluorescent surface of said panel, a funnel, an electron gun for producing a beam of electrons, a single electromagnetic deflector, and a plurality of static deflector means for deflecting and accelerating said beam of electrons, wherein said beam of electrons is accelerated by electric fields formed by said plurality of static deflectors after said beam of electrons passes through said single electromagnetic deflector, wherein voltages applied to each of said plurality of static deflector means are below a voltage applied to said fluorescent surface of said panel.

2. A cathode ray tube comprising:

a vacuum tube having a panel, a fluorescent surface, a funnel, an electron gun for producing a beam of electrons, a single electromagnetic deflector, and a plurality of static deflector means for deflecting and accelerating said beam of electrons, wherein said beam of electrons is accelerated by electric fields formed by said plurality of static deflectors after said beam of electrons passes through said single electromagnetic detector, wherein said plurality of static deflector means includes first through fourth static deflectors, respectively arranged in order of an advancing direction of said beam of electrons, said first static deflector generating an electric field in a region including an electromagnetic field generated by said electromagnetic deflector; and said first through fourth static deflectors generate a low electric field, a high electric field, a low electric field, and a high electric field, respectively.

3. The cathode ray tube of claim 2, wherein each of said four static deflectors includes a deflection electrode to which a voltage is applied so as to form an electric field in a corresponding region of said cathode ray tube.

4. The cathode ray tube of claim 3, wherein the voltages applied to said deflection electrodes of said first through fourth deflectors are 20%±20%, 100%±20%, 30%±20%, and 100%±20% of the voltage to be applied to said fluorescent surface, respectively.

5. A cathode ray tube with reduced power consumption, comprising:

an electron gun, to which a low acceleration voltage is applied, for generating a low initial energy level electron beam;

electromagnetic deflector means for generating a weak electromagnetic field to deflect the low initial energy level beam; and static deflector means including a plurality of electrodes for applying an electric field to the electron beam to further deflect, accelerate, and focus the electron beam on a fluorescent screen;

wherein the deflection and acceleration by said static deflector means reduces the power consumption of said electromagnetic deflector means, and voltages applied to each of said plurality of static deflector means are below a voltage applied to said fluorescent screen.

6. A cathode ray tube with reduced power consumption, comprising:

an electron gun, to which a low acceleration voltage is applied, for generating a low initial energy level electron beam;

electromagnetic deflector means for generating a weak electromagnetic field to deflect the low initial energy level beam; and static deflector means including a plurality of electrodes for applying an electric field to the electron beam to further deflect, accelerate, and focus the electron beam on a fluorescent screen;

wherein the deflection and acceleration by said static deflector means reduces the power consumption of said electromagnetic deflector means, said static deflector means includes first through fourth static deflectors respectively arranged in order of an advancing direction of said beam of electrons, and said first static deflector generating an electric field in a region including an electromagnetic field generated by said electromagnetic deflector means, and said first through fourth static deflectors generate a low electric field, a high electric field, a low electric field, and a high electric field, respectively.

7. The cathode ray tube of claim 6, wherein each of said four static deflectors includes a deflection electrode to which a voltage is applied so as to form an electric field in a corresponding region of said cathode ray tube.

8. The cathode ray tube of claim 7, wherein the voltage applied to the deflection electrode of the first static deflector is less than the voltages applied to the remaining deflection electrodes.

9. The cathode ray tube of claim 7, wherein the voltages applied to said deflection electrodes of said first through fourth deflectors are 20%±20%, 100%±20%, 30%±20%, and 100%±20% of the voltage to be applied to said fluorescent screen, respectively.

10. A method of deflecting a beam of electrons onto a fluorescent screen utilizing a cathode ray tube with reduced power consumption, comprising the steps of:

(a) applying a low acceleration voltage to an electron gun;

(b) generating the beam of electrons with a low initial energy level using the electron gun;

(c) generating a weak electromagnetic field with an electromagnetic deflector for partially deflecting the beam of electrons; and (d) applying a plurality of voltages to a plurality of static deflectors to deflect, accelerate, and focus the beam of electrons on a fluorescent screen;

wherein said steps (a) and (d) reduce power consumption required by said step (c), and the plurality of applied voltages are less than a voltage applied to said fluorescent screen.

11. A method of deflecting a beam of electrons onto a fluorescent screen utilizing a cathode ray tube with reduced power consumption, comprising the steps of:

(a) applying a low acceleration voltage to an electron gun;

(b) generating the beam of electrons with a low initial energy level using the electron gun;

(c) generating a weak electromagnetic field with an electromagnetic deflector for partially deflecting the beam of electrons; and (d) applying a plurality of voltages to a plurality of static deflectors to deflect, accelerate, and focus the beam of electrons on a fluorescent screen;

wherein said steps (a) and (d) reduce power consumption required by said step (c), the plurality of applied voltages are applied to first through fourth static deflectors respectively arranged in order of an advancing direction of said beam of electrons, said first static deflector generating an electric field in a region including said weak electromagnetic field, and the first through fourth static deflectors generate a low electric field, a high electric field, a low electric field, and a high electric field, respectively.

12. The method of claim 11, wherein each of the four static deflectors includes a deflection electrode to which a voltage is applied so as to form an electric field in a corresponding region of said cathode ray tube.

13. The method of claim 12, wherein the voltages applied to the deflection electrodes of said first through fourth deflectors are 20%±20%, 100%±20%, 30%±20%, and 100%±20% of the voltage to be applied the said fluorescent screen, respectively.

14. The method of claim 12, wherein the voltage applied to the deflection electrode of the first static deflector is less than the voltages applied to the remaining deflection electrodes.

15. A cathode ray tube with reduced power consumption, comprising:

an electron gun, to which a low acceleration voltage is applied, for generating a low initial energy level electron beam;

an electromagnetic deflector generating a weak electromagnetic field to deflect the low initial energy level beam; and static deflector means including a plurality of electrodes having voltages applied thereto, for applying an electric field to the electron beam to further deflect, accelerate, and focus the electron beam on a fluorescent screen;

said static deflector means reducing the power consumption of said electromagnetic deflector though its deflection and acceleration, and the electrode nearest to said electromagnetic deflector has an applied voltage less than the voltages applied to the remaining plurality of electrodes.

16. A method of deflecting a beam of electrons onto a fluorescent screen utilizing a cathode ray tube with reduced power consumption, comprising the steps of:

(a) applying a low acceleration voltage to an electron gun;

(b) generating the beam of electrons with a low initial energy level using the electron gun;

(c) generating a weak electromagnetic field with an electromagnetic deflector for partially deflecting the beam of electrons; and (d) applying a plurality of voltages to a plurality of static deflectors to deflect, accelerate, and focus the beam of electrons on a fluorescent screen;

wherein said steps (a) and (d) reduce power consumption required by said step (c), and said step (d) of applying a plurality of voltages includes applying a voltage to the static deflector nearest said electromagnetic deflector which is less than the voltages applied to the remaining plurality of static deflectors.

17. A cathode ray tube comprising:

a vacuum tube having a panel, a fluorescent surface, a funnel, an electron gun for producing a beam of electrons with a low initial energy level, a single electromagnetic deflector, and a plurality of static deflector means for deflecting, for accelerating and for increasing the energy level of said beam of electrons, after said beam of electrons passes through said single electromagnetic deflector to the point of impact upon the fluorescent surface.

18. A method of deflecting a beam of electrons onto a fluorescent screen utilizing a cathode ray tube with reduced power consumption, comprising the steps of:

(a) applying a low acceleration voltage to an electron gun;

(b) generating the beam of electrons with a low initial energy level using the electron gun;

(c) generating a weak electromagnetic field with an electromagnetic deflector for partially deflecting the beam of electrons; and (d) applying a plurality of voltages to a plurality of static deflectors to deflect, accelerate, and increase the energy level of the beam of electrons at the point of impact on a fluorescent screen to a higher energy level than said low initial energy level.

* * * * *